US009394649B2

(12) United States Patent
Nagai

(10) Patent No.: US 9,394,649 B2
(45) Date of Patent: Jul. 19, 2016

(54) SHEET MANUFACTURING APPARATUS

(71) Applicant: SEIKO EPSON CORPORATION, Tokyo (JP)

(72) Inventor: Yoshiyuki Nagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/625,592

(22) Filed: Feb. 18, 2015

(65) Prior Publication Data

US 2015/0247286 A1 Sep. 3, 2015

(30) Foreign Application Priority Data

Feb. 28, 2014 (JP) ..... 2014-038190

(51) Int. Cl.

*D21F 7/00* (2006.01)
*D21F 9/00* (2006.01)
*D04H 1/732* (2012.01)

(52) U.S. Cl.

CPC . *D21F 7/003* (2013.01); *D21F 9/00* (2013.01)

(58) Field of Classification Search

CPC ..... D21D 5/24; D21D 5/00; B27N 3/04; B27N 3/12; D21H 11/14; D21H 25/005; D04H 1/732; A61F 2013/530007; B07B 9/00; B07B 1/00; D21C 5/025; D21B 1/08; D21B 1/028; D21B 1/063; D21B 1/32; D21F 7/00; D21F 9/00

See application file for complete search history.

(56) References Cited

U.S. PATENT DOCUMENTS 2,646,381 A * 7/1953 Duvall ..... B27N 1/00 19/58
2,972,171 A * 2/1961 Heritage ..... D21D 5/00 162/55
3,418,095 A * 12/1968 Kleist ..... C03B 37/06 264/12
3,611,508 A * 10/1971 Reinhall ..... D04H 1/425 19/303
3,717,905 A * 2/1973 Furbeck ..... A61F 13/15626 19/148
4,440,635 A * 4/1984 Reiniger ..... B02C 18/03 209/306

(Continued)

FOREIGN PATENT DOCUMENTS

JP 09-158024 A 6/1997
JP 2001140184 A * 5/2001

(Continued)

OTHER PUBLICATIONS

U.S. Appl. No. 14/625,592, Jose Fortuna.*

*Primary Examiner* — Jose Fortuna
(74) *Attorney, Agent, or Firm* — Global IP Counselors, LLP

(57) ABSTRACT

A sheet manufacturing apparatus includes a defibrating unit configured to defibrate a defibration object containing fibers in the air, a supply unit configured to supply additive agents to defibrated material that has been defibrated in the defibrating unit, a deposition unit configured to deposit the defibrated material and the additive agents, and a heating unit configured to heat a web deposited by the deposition unit. The supply unit has a moisture adding unit configured to add moisture to the additive agents.

6 Claims, 2 Drawing Sheets

(56) References Cited

U.S. PATENT DOCUMENTS 5,013,405 A * 5/1991 Izard ..... C04B 26/02 162/101
5,324,389 A * 6/1994 Spencer ..... D21B 1/028 162/4
5,437,418 A * 8/1995 Graef ..... A61F 13/15707 241/152.2
6,274,522 B1 8/2001 Sameshima et al.
8,882,965 B2 * 11/2014 Yamagami ..... D21B 1/08 162/261
8,986,505 B2 * 3/2015 Oguchi ..... B07B 1/00 162/259
9,045,857 B2 * 6/2015 Gomi ..... D21B 1/063
2005/0064169 A1 * 3/2005 Schiegl ..... B27N 1/0254 428/297.4
2012/0297560 A1 * 11/2012 Zwick ..... C11D 3/046 15/104.93
2014/0027075 A1 * 1/2014 Yamagami ..... D21B 1/08 162/4
2014/0290887 A1 * 10/2014 Gomi ..... D21B 1/063 162/252
2014/0290889 A1 * 10/2014 Oguchi ..... B07B 1/00 162/259
2014/0374047 A1 * 12/2014 Yamagami ..... D21B 1/08 162/261
2015/0096702 A1 * 4/2015 Higuchi ..... D21D 5/24 162/261
2015/0184341 A1 * 7/2015 Tanaka ..... D21F 7/00 162/252
2015/0240418 A1 * 8/2015 Oguchi ..... D21D 5/24 162/109
2015/0240422 A1 * 8/2015 Oguchi ..... D21F 9/00 162/202
2015/0247286 A1 * 9/2015 Nagai ..... D21F 7/003 162/261
2015/0252530 A1 * 9/2015 Higuchi ..... D21F 2/00 162/363
2015/0275429 A1 * 10/2015 Higuchi ..... D21F 9/04 162/261
2015/0275430 A1 * 10/2015 Higuchi ..... D21F 9/04 162/261
2015/0275435 A1 * 10/2015 Seki ..... D21H 17/20 162/5
2015/0292153 A1 * 10/2015 Miyazawa ..... D21D 5/24 162/261

FOREIGN PATENT DOCUMENTS

JP 5214407 B2 * 6/2013 ..... F26B 11/16
WO WO 9720090 A1 * 6/1997 ..... B41J 2/17513
WO WO 0071810 A1 * 11/2000 ..... B07B 4/02
WO WO 2010053035 A1 * 5/2010 ..... F26B 11/16
WO WO 2012095928 A1 * 7/2012 ..... D21B 1/08

* cited by examiner

SHEET MANUFACTURING APPARATUS

CROSS-REFERENCE TO RELATED APPLICATIONS

This application claims priority to Japanese Patent Application No. 2014-038190 filed on Feb. 28, 2014. The entire disclosure of Japanese Patent Application No. 2014-038190 is hereby incorporated herein by reference.

BACKGROUND

1. Technical Field

The present invention relates to a sheet manufacturing apparatus.

2. Related Art

Conventionally, a liquid absorbing body is formed by supplying additive agents, such as thermal fusion-bondable materials, to natural cellulose fibers and synthetic fibers, then mixing and defibrating in the air to form a mat, and heating the mat (e.g, see Japanese Laid-Open Patent Publication No. H9-158024).

However, when additive agents are supplied to natural cellulose fibers in the manufacturing process of the liquid absorbing body, the problem was that the additive agents were charged by static electricity and adhered to the interior of the transfer path, so the additive agents could not be stably transferred.

SUMMARY

The present invention solves at least a portion of the problems described above and can be implemented in the following embodiments or applied examples.

A sheet manufacturing apparatus in this applied example is a sheet manufacturing apparatus provided with a defibrating unit configured to defibrate a defibration object that contains fibers in the air, a supply unit configured to supply additive agents to defibrated material that has been defibrated in the defibrating unit, a deposition unit configured to deposit the defibrated material and the additive agents, and a heating unit configured to heat a web deposited by the deposition unit. The supply unit has a moisture adding unit configured to add moisture to the additive agents.

According to this configuration, moisture is added to the additive agents being supplied. By doing this, static electricity becomes difficult to form because the additive agents carry moisture. Additionally, adherence of the additive agents due to charging can be prevented.

The sheet manufacturing apparatus in the above applied example is provided with a first transfer unit configured to transfer the defibrated material to the deposition unit from the defibrating unit. The supply unit has a storage unit configured to store the additive agents and a second transfer unit configured to transfer the additive agents from the storage unit to the first transfer unit. The moisture adding unit is configured to add moisture to an interior of the second transfer unit.

According to this configuration, electrostatic charging of the additive agents and adherence to the interior of the transfer unit can be suppressed because moisture is added to the interior of the transfer unit for transferring additive agents.

The moisture adding unit of the sheet manufacturing apparatus related to the above applied example has a sprayer port configured to spray moisture. The sprayer port is arranged in the second transfer unit on a side closer to the storage unit than the first transfer unit.

According to this configuration, charging of the additive agents and adhering to the inside of the transfer unit are suppressed by adding moisture from the upstream side in the transfer direction in the second transfer unit.

The supply unit of the sheet manufacturing apparatus related to the above applied examples is configured to select to supply additive agents and not supply additive agents. The moisture adding unit is configured to add moisture when the additive agents are supplied.

According to this configuration, because moisture is added only when additive agents are supplied from the supply unit, it is possible to limit excess moisture that is the result of adding moisture when additive agents are not supplied.

The supply unit of the sheet manufacturing apparatus related to the above applied examples is configured to control a supplied amount of the additive agents. The moisture adding unit is configured to control adding of moisture. The moisture adding unit is configured to control the adding of moisture in response to the supplied amount of the additive agents.

According to this configuration, the appropriate amount of moisture can be added by also controlling the added amount of moisture to correspond to the supplied amount of additive agents.

In the sheet manufacturing apparatus related to the above applied examples, a second moisture adding unit configured to add moisture to the first transfer unit is provided further downstream in a transfer direction of the defibrated material than the flow combining portion of the first transfer unit and the second transfer unit.

According to this configuration, a material that is a mixture of fibers and additive agents becomes more difficult to charge by adding moisture; and charging and adherence to the interior of the first transfer unit can be suppressed.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
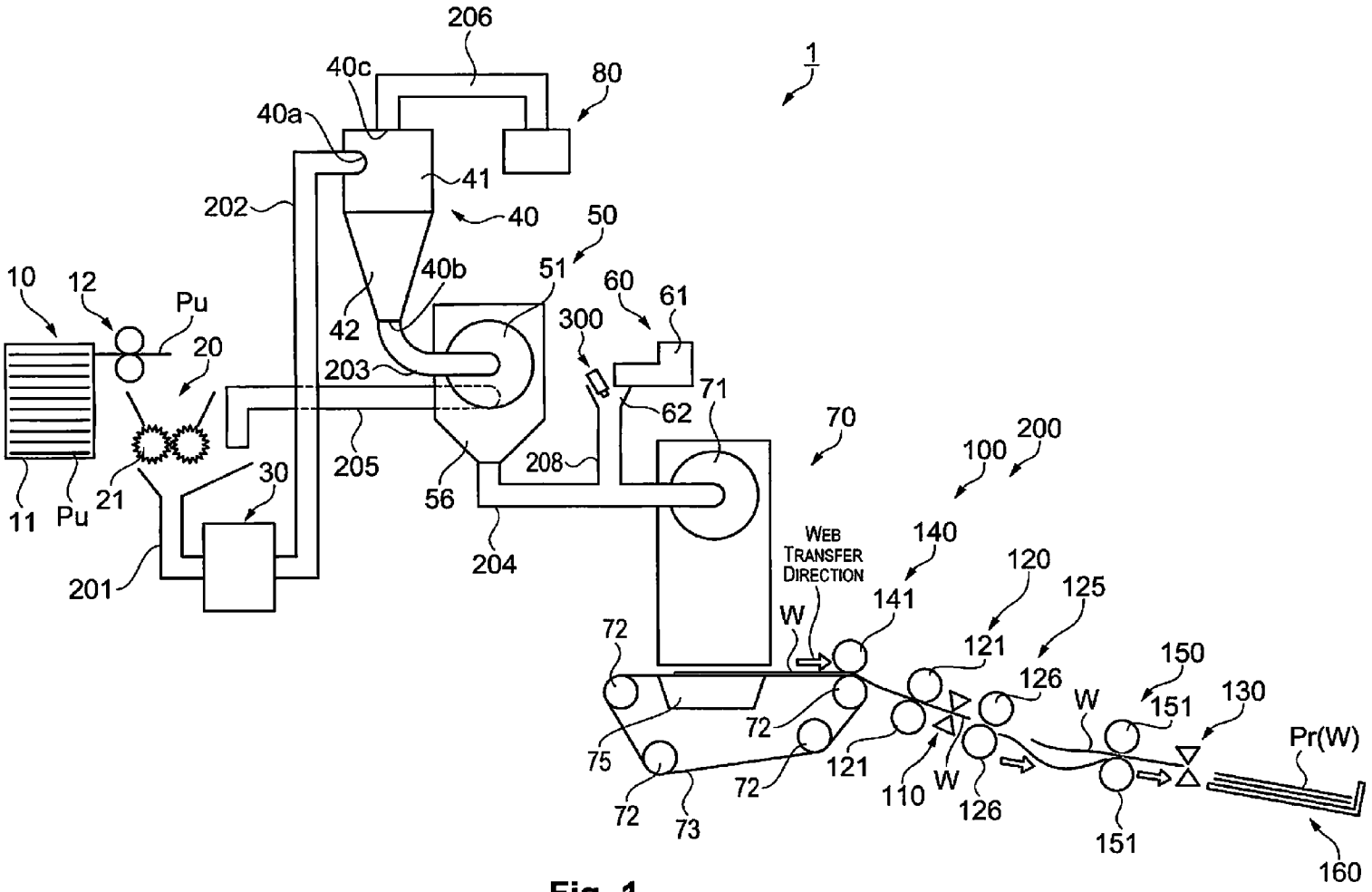
FIG. 1 is a schematic diagram showing the configuration of a sheet manufacturing apparatus related to a first embodiment.

First and second embodiments of the present invention are described below with reference to the drawings. In the drawings below, the scale of each part differs from the actual scale in order for each part to be a size that can be discerned.

First Embodiment

First, the configuration of the sheet manufacturing apparatus is explained. For example, the sheet manufacturing apparatus is based on a technology in which the raw material (defibration object) Pu, such as refined pulp sheets or used papers, is formed into a new sheet Pr. The sheet manufacturing apparatus related to this embodiment is provided with a defibrating unit that defibrates the defibration object containing fibers in the air, a supply unit that supplies additive agents to the defibrated material that was defibrated in the defibrating unit, a deposition unit that deposits the defibrated material and the additive agents, and a heating unit that heats the web deposited on the deposition unit, wherein the supply unit has a moisture adding unit for adding moisture to the additive agents. A specific configuration of the sheet manufacturing apparatus is explained below.

Figure 2:
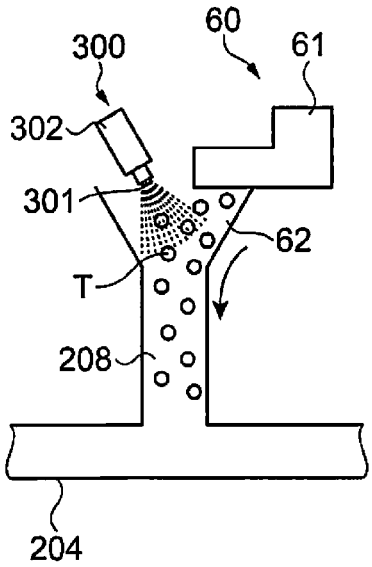
FIG. 2 is a schematic diagram showing the configuration of the additive agent supply unit related to a first embodiment.

FIG. 1 is a schematic diagram showing the configuration of a sheet manufacturing apparatus related to this embodiment. FIG. 2 is a schematic diagram showing the configuration of the additive agent supply unit. As shown in FIG. 1, the sheet manufacturing apparatus 1 of this embodiment is provided with a feed-in unit 10, a crushing unit 20, a defibrating unit 30, a classifying unit 40, a screening unit 50, an additive agent supply unit 60 as the supply unit, a deposition unit 70, and a heating unit 150. A control unit is also supplied to control these parts.

The feed-in unit 10 feeds in used paper Pu into the crushing unit 20. For example, the feed-in unit 10 is provided with a tray 11 where a plurality of sheets of used paper Pu is stacked and stored, and an automatic transfer mechanism 12 that can continuously feed in the used paper Pu in the tray 11 into the crushing unit 20. The used paper Pu fed into the sheet manufacturing apparatus 1 is, for example, A4-size paper that is currently in common use in offices.

The crushing unit 20 cuts up the supplied used paper Pu into pieces of paper of several centimeters square. The crushing unit 20 is an apparatus with a configuration that is provided with a crushing blade 21 to widen the cutting width of the blade of an ordinary shredder. Thus, the supplied used paper Pu can be easily cut into pieces of paper. Then, the cut-up crushed paper is supplied through a transfer path 201 to the defibrating unit 30.

The defibrating unit 30 is provided with a rotating blade (not shown) that rotates to defibrate by untangling the crushed paper (defibration object including fibers) supplied from the crushing unit 20 into a fibrous form. In this application, the material that is defibrated by the defibrating unit 30 is referred to as the defibration object, and the material passed by the defibrating unit 30 is referred to as the defibrated material. The defibrating unit 30 in this embodiment defibrates in a dry system in the air. The defibrating process of the defibrating unit 30 defibrates and separates the coating materials on the paper, such as printed inks or toners, and blur-preventing materials, into particles no larger than several tens of micrometers (μm) (hereinafter, referred to as "ink particles"). Consequently, the defibrated material output from the defibrating unit 30 is fibers and ink particles obtained by defibrating the pieces of paper. Then the unit becomes a mechanism that generates airflow by rotating the rotating blade and transfers in the air the defibrated fibers that passed through the transfer path 202 to the classifying unit 40 by carrying the fibers on the airflow. As needed, an airflow generating apparatus may be separately provided to generate airflow to transfer defibrated fibers that were defibrated in the defibrating unit 30 through the transfer path 202 to the classifying unit 40.

The classifying unit 40 uses the airflow to classify the introduced material that was input. In this embodiment, the defibrated material, which is the introduced material, is classified into ink particles and fibers. For example, the classifying unit 40 can use a cyclone to classify by airflow the transferred fibers into ink particles and deinked fibers (deinked defibrated material). Another type of airflow classifier may be used instead of the cyclone. In this case, an airflow classifier other than a cyclone is used, for example, an elbow jet or an eddy classifier. The airflow classifier generates a rotating airflow to separate and classify based on the differences in the centrifugal force received according to the size and density of the defibrated material. Thus, the material is classified into ink particles that are relatively small and have low density and fibers that are larger than ink particles and have high density. The removal of ink particles from the fibers is referred to as deinking.

The classifying unit 40 in this embodiment is a tangential inlet cyclone and comprises an inlet 40*a* that inputs from the defibrating unit 30, a cylindrical part 41 that attaches the inlet 40*a* in the tangential direction, a conical part 42 that is connected to the lower part of the cylindrical part 41, a lower outlet 40*b* that is installed in the lower part of the conical part 42, and an upper discharge port 40*c* for discharging fine particles that is installed in the center of the upper part of the cylindrical part 41. The diameter of the conical part 42 becomes smaller in the downward direction of the perpendicular.

In the classifying process, the airflow carrying the defibrated material that was introduced from the inlet 40*a* of the classifying unit 40 is changed into circular motion by the cylindrical part 41 and the conical part 42 and classifies by applying centrifugal force. Then fibers that are larger and have higher density than the ink particles move to the lower outlet 40*b*, and ink particles that are relatively small and have low density are introduced as fine particles with air to the upper discharge port 40*c*, and deinking proceeds. Then, a short fiber mixture that contains a large quantity of ink particles is discharged from the upper discharge port 40*c* of the classifying unit 40. The short fiber mixture that contains a large quantity of the discharged ink particles is then passed through a transfer path 206 connected to the upper discharge port 40*c* of the classifying unit 40 to be recovered in a receiving unit 80. In addition, the classified material that contains the classified fibers that passed through a transfer path 203 from the lower outlet 40*b* of the classifying unit 40 is transferred in the air to the screening unit 50. The transfer from the classifying unit 40 to the screening unit 50 may be by airflow when classifying, or may be by gravity from the classifying unit 40, which is on top, to the screening unit 50, which is on the bottom. A suction unit for efficiently suctioning the short fiber mixture from the upper discharge port 40*c* may be positioned in the upper discharge port 40*c* of the classifying unit 40 or the transfer path 206, and the like.

The screening unit 50 screens the classified material that contains fibers classified by the classifying unit 40 that was passed from a drum unit 51 that has a plurality of openings. More specifically, the classified material that contains fibers classified by the classifying unit 40 is screened into passed material that passed through the openings and residue that did not pass through the openings. The screening unit 50 of this embodiment is provided with a mechanism to disperse the classified material in the air by circular motion.

Then, the passed material (defibrated material) that passed through the openings by the screening of the screening unit 50 is transferred to the deposition unit 70. More specifically, the screening unit 50 and the deposition unit 70 are connected by transfer path 204, which is the first transfer unit. Then, the passed material (defibrated material) that passed through the openings by the screening of the screening unit 50 is received by a hopper 56, and then transferred in the air via transfer path 204 to the deposition unit 70. The transfer from the screening unit 50 to the deposition unit 70 may be transfer by a blower, which is not shown, that generates airflow, or transfer by gravity from the screening unit 50 on the top to the deposition unit 70 on the bottom. In addition, the residue that did not pass through the openings by the screening of the screening unit 50 is returned again as defibration object via transfer path 205, which is the transfer path, to the defibrating unit 30. Thus, the residue is not discarded and is reused (recycled).

In addition, the additive agent supply unit 60 for supplying additive agents to the passed material (defibrated material) being transferred is provided between the screening unit 50 and the deposition unit 70 in the transfer path 204. In addition to resin (e.g., fusion-bondable resin or thermoplastic resin), the additive agents are, for example, flame retardants, whitening agents, sheet strengthening agents, and sizing agents. The forms of the additive agents may be powders or fibers. The additive agents are stored in an additive agent storage unit 61, which is the storage unit provided in the additive agent supply unit 60.

The additive agent supply unit 60 is provided with transfer path 208 as the second transfer unit that is connected to transfer path 204. Additive agent F stored in the additive agent storage unit 61 is supplied from a supply port 62 to transfer path 208 by a discharge mechanism, such as a screw feeder, and is transferred from transfer path 208 to transfer path 204.

In addition, a moisture adding unit 300 is arranged in the additive agent supply unit 60. The moisture adding unit 300 adds moisture to the interior of the transfer path 208. As shown in FIG. 2, the moisture adding unit 300 is provided with a liquid storage unit 302 that stores water for adding moisture and a sprayer port 301 that sprays water moisture. The sprayer port 301 is arranged in transfer path 208 on the side closer to the additive agent storage unit 61 than transfer path 204. In this embodiment, the sprayer port 301 is arranged to face the supply port 62 that supplies additive agent T from the additive agent storage unit 61. Thus, moisture is added to additive agent T in the transfer direction of additive agent F, and the additive agent T can be prevented from being charged and adhering to transfer path 208. In addition, moisture is added to the interior of transfer path 208.

Additionally, the additive agent supply unit 60 can select to supply or not supply additive agent T. The moisture adding unit 300 is configured so that moisture is added when additive agent T is supplied. Consequently, the process for adding moisture is not conducted when additive agent T is not supplied. Thus, it is possible to limit excess moisture that is the result of adding moisture when additive agent T is not supplied. Furthermore, the additive agent supply unit 60 can control the supplied amount of additive agent T. The moisture adding unit 300 is configured so that the addition of moisture is controlled in response to the supplied amount of additive agent T. For example, when additive agent T that is supplied is a fusible resin, 1 to 8% by weight of water is given with respect to the supplied weight of the fusible resin. Thus, moisture can be appropriately added for the added fusible resin, and excess moisture can be limited. When excess moisture results, additive agent T sometimes has difficulty moving in transfer path 208 and transfer path 204. As shown in FIG. 2, transfer path 208 has a part with a pipeline form and a part that expands at the end of the pipeline form. The moisture is sprayed in a mist from the sprayer port 301 toward the expanded part. From this expanded part, additive agent T supplied from the supply port 62 is easily received, and moisture is easily added to additive agent T.

Returning to FIG. 1, the deposition unit 70 deposits passed material containing fibers (defibrated material) that was fed in from the transfer path 204 and additive agents (material containing resin) to form a web W. The deposition unit 70 has a mechanism that uniformly disperses fibers in the air and a mechanism that deposits the dispersed fibers on a mesh belt 73. The web W related to this embodiment refers to the form of the material including fibers and resin. Consequently, even if there are changes in the state of the web, such as the dimensions when the web is heated, or subjected to pressure, or cut, or transferred, this is still indicated as the web.

First, a forming drum 71 that feeds in fibers and resin to the interior is arranged in the deposition unit 70 as the mechanism that uniformly disperses fibers in the air. By driving the forming drum 71 to rotate, the resin (additive agent) can be uniformly mixed into the passed material (fibers). A screen having a plurality of small holes is provided in the forming drum 71. The forming drum 71 is driven to rotate, and the resin (additive agents) is uniformly mixed in the passed material (fibers), and the fibers that passed through the small holes and the mixture of fibers and resin can be uniformly dispersed in the air.

An endless mesh belt 73 that is formed by using the stretching rollers 72 to stretch the mesh is arranged below the forming drum 71. At least one of the stretching rollers 72 is rotated, and the mesh belt 73 moves in one direction.

In addition, a suction apparatus 75 is provided perpendicularly below the forming drum 71 as the suction unit that generates airflow downward in the perpendicular direction through the mesh belt 73. The suction apparatus 75 can suction the fibers dispersed in the air on the mesh belt 73.

The fibers that passed through the screen with small holes of the forming drum 71 are deposited on the mesh belt 73 by the suction force due to the suction apparatus 75. By moving the mesh belt 73 in one direction, the web W that includes fibers and resin and is deposited in a continuous shape can be formed. Due to the continuous dispersion from the forming drum 71 and moving the mesh belt 73, the web W is formed in a continuous band. The mesh belt 73 may be made of either metal, resin, or nonwoven cloth, if fibers can be deposited, and airflow can be passed. If the hole diameter of the mesh of the mesh belt 73 is too large, fibers enter into the mesh and the web W (sheet) becomes uneven when formed. On the other hand, if the hole diameter of the mesh is too small, the suction apparatus 75 has difficulty forming a stable airflow. Therefore, preferably, the hole diameter of the mesh is appropriately adjusted. The suction apparatus 75 can be configured to form an airtight box with an opening for a window having the desired size below the mesh belt 73, and suctions air through the window to produce negative pressure inside the box with respect to the atmosphere.

The web W formed on the mesh belt 73 is transferred by a transfer unit 100. The transfer unit 100 of this embodiment indicates the transfer process of the web W from the mesh belt 73 until finally feeding into a stacker 160 as sheets Pr (web W). Consequently, in addition to the mesh belt 73, various rollers function as a part of the transfer unit 100. The transfer unit may be the transfer belt and at least one of the transfer rollers. Specifically, the web W formed on the mesh belt 73, which is a part of the transfer unit 100, is transferred along the transfer direction (arrow in the drawing) by the rotational motion of the mesh belt 73. Next, the web W transfers along the transfer direction (arrow in the drawing) from the mesh belt 73. In this embodiment, the deposition unit 70 and the transfer unit 100 are a part of a forming unit 200 that uses the web W to form the sheet Pr.

A pressure unit is arranged on the downstream side of the deposition unit 70 in the transfer direction of the web W. The pressure unit in this embodiment is pressure unit 140 that has roller 141 for applying pressure to the web W. By passing the web W between the roller 141 and a stretching roller 72, pressure can be applied to the web W. By doing this, the strength of the web W can be improved.

Rollers 120 before the cutting unit are arranged on the downstream side of the pressure unit 140 in the transfer direction of the web W. The rollers 120 before the cutting unit are composed of a pair of rollers 121. One of the pair of rollers 121 is a drive control roller, and the other is a following roller.

In addition, a one-way clutch is used in the drive transmission unit to rotate the rollers 120 before the cutting unit. The one-way clutch is configured to have a clutch mechanism that transmits rotational force in only one direction and idles for the opposite direction. Thus, when there is a velocity difference between the rollers 125 after the cutting unit and the rollers 120 before the cutting unit, and excessive tension is applied to the web W, limiting of the tension on the web W and tearing of the web W can be prevented because of idling on the side of the rollers 120 before the cutting unit.

A cutting unit 110 for cutting the web W in a direction that intersects the transfer direction of the web W being transferred is arranged on the downstream side of the rollers 120 before the cutting unit in the transfer direction of the web W. The cutting unit 110 is provided with a cutter and cuts the continuous web W into sheet shapes at the cutting positions set at specified lengths. For example, the cutting unit 110 can use a rotary cutter. By doing this, cutting is possible while the web W is transferred. Consequently, the transfer of the web W is not stopped during cutting, and the manufacturing efficiency can be improved. The cutting unit 110 may use various cutters other than a rotary cutter.

The rollers 125 after the cutting unit are arranged further on the downstream side in the transfer direction of the web W than cutting unit 110. The rollers 125 after the cutting unit are composed of a pair of rollers 126. One of the pair of rollers 126 is a drive control roller, and the other is a following roller.

In this embodiment, tension can be applied to the web W depending on the velocity difference between the rollers 120 before the cutting unit and the rollers 125 after the cutting unit. The configuration is such that when tension is applied to the web W, the cutting unit 110 is driven to cut the web W.

The heating unit 150 for heating the web W is arranged further on the downstream side in the transfer direction of the web W than the rollers 125 after the cutting unit. The heating unit 150 in this embodiment is arranged with a pair of heat and pressure application rollers 151 for heating and applying pressure to the web W. The heating unit 150 bonds (fixes) together fibers contained in the web W with resin. By providing a heating component, such as a heater, in the center part of the rotation shaft of the heat and pressure application rollers 151, and passing the web W between the pair of heat and pressure application rollers 151, heat and pressure can be applied to the web W being transferred. By applying heat and pressure to the web W by the pair of heat and pressure application rollers 151, the resin melts and the fibers easily become tangled; and the interval between fibers shortens, and contact points between the fibers increase. Thus, the density increases, and the strength as a web W is improved.

A post-cutting unit 130 for cutting the web W along the transfer direction of the web W is arranged further on downstream side in the transfer direction of the web W than the heating unit 150. The post-cutting unit 130 is provided with a cutter and cuts at specified cutting positions in the transfer direction of the web W. Thus, sheets Pr (web W) having the desired size are formed. The cut sheets Pr (web W) are stacked on the stacker 160.

The sheet related to this embodiment has raw materials that include fibers such as used paper or pulp, and primarily refers to a sheet form. However, the shape is not limited to a sheet, a board form or a web form (shape having indentations and bumps) is acceptable. The raw materials may be plant fibers such as cellulose, and the like; synthetic fibers such as polyethylene terephthalate (PET), polyester, and the like; and animal fibers such as wool, silk, and the like. In this application, a sheet is divided into paper and nonwoven cloth. Paper includes embodiments in a thin sheet, and includes recording paper, wallpaper, wrapping paper, colored paper, and Kent paper that have the objecting of writing or printing. Nonwoven cloth is thicker and has less strength than paper, and includes nonwoven cloth, fiberboard, tissue paper, paper towels, cleaning cloths, filters, liquid absorbing materials, sound absorbing materials, cushioning materials, and mats.

In addition, the used paper in the above embodiments mainly indicates paper for printing and is regarded as used paper unrelated to whether or not it has been used, if a material that was formed into paper is used as the raw material.

According to the above embodiments, the following effects can be obtained.

By spraying water from the moisture adding unit 300 provided in the additive agent supply unit 60 toward transfer path 208, moisture is added to the additive agents supplied to transfer path 208. Thus, the additive agents become difficult to charge because of the moisture that is held and are prevented from adhering to transfer path 208 of the additive agents.

Second Embodiment

Next, the configuration of the sheet manufacturing apparatus related to the second embodiment is explained. A sheet manufacturing apparatus 1*a* related to this embodiment adds a second moisture adding unit 310 to the configuration of the sheet manufacturing apparatus 1 related to the first embodiment. Consequently, structures other than the second moisture adding unit 310 are omitted from the description because the structures are similar to the structures of the sheet manufacturing apparatus 1 related to the first embodiment. The details are described below.

Figure 3:
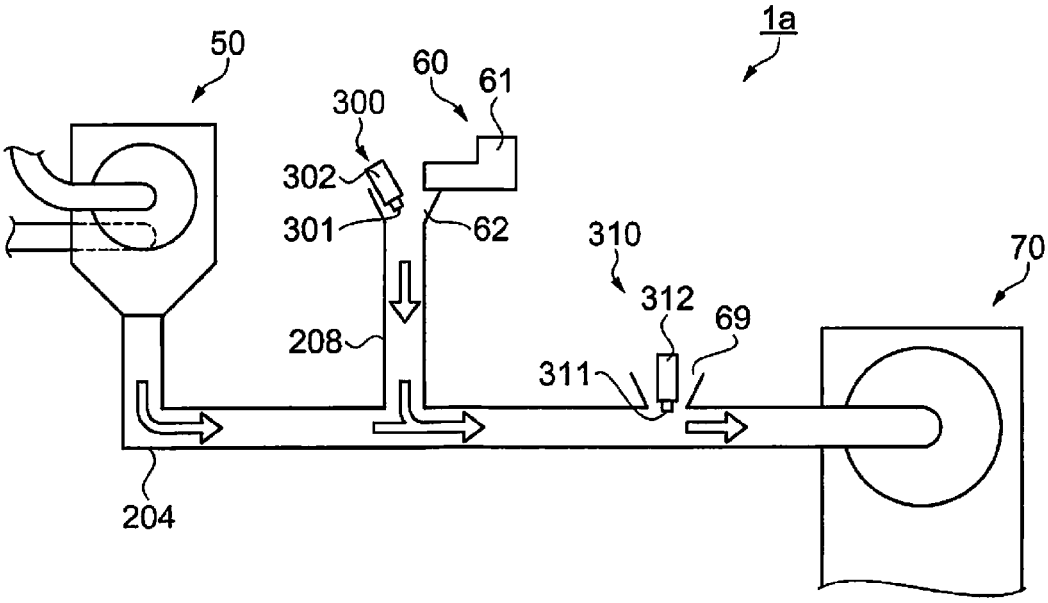
FIG. 3 is a partial schematic diagram showing the configuration of the sheet manufacturing apparatus related to a second embodiment.

FIG. 3 is a partial schematic drawing that shows the configuration of the sheet manufacturing apparatus related to this embodiment. As shown in FIG. 3, the sheet manufacturing apparatus 1*a* of this embodiment is provided with a second moisture adding unit 310 that adds moisture to transfer path 204 further downstream in the transfer direction of the defibrated material than the flow combining portion of transfer path 204, which is the first transfer unit, and transfer path 208, which is the second transfer unit.

The second moisture adding unit 310 is provided with a liquid storage unit 312 for storing liquid (e.g., water) for adding moisture and a sprayer port 311 for spraying liquid. The sprayer port 311 is arranged toward transfer path 204 from the opening part 69. By doing this, moisture can be easily added to the transfer material that is transferred in transfer path 204. In addition, moisture can be easily added to the interior of transfer path 204.

In addition, the second moisture adding unit 310 may be configured to conduct a moisture adding process in response to the presence or absence of passed material that is the defibrated material and that additive agents that were mixed together and passed through transfer path 204. In this case, the moisture adding process is conducted when the passed material is passed through transfer path 204. The moisture adding process is not conducted when passed material is not passed to transfer path 204. Furthermore, the addition of moisture may be controlled in response to the transferred amount of passed material that passed through transfer path 204. Thus, the addition of moisture can be controlled to an appropriate amount, and excess moisture can be limited.

According to the above embodiment, in addition to the effects of the first embodiment, the following effects can be obtained.

A material of a mixture of fibers and additive agents becomes more difficult to charge by the addition of moisture further on the downstream side in the transfer direction of the defibrated material than the flow combining portion of transfer path 204 and transfer path 208, and charging and adherence to the interior of transfer path 204 can be suppressed.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus, comprising:

a defibrating unit configured to dry-defibrate a defibration object containing fibers;

a supply unit configured to supply additive agents to defibrated material that has been dry-defibrated in the defibrating unit, the supply unit having a moisture adding unit configured to add moisture to the additive agents to be supplied to the defibrated material;

a deposition unit configured to deposit the defibrated material and the additive agents which have been added to the defibrated material at the supply unit, to create a web; and a heating unit configured to heat the web created at the deposition unit.

2. The sheet manufacturing apparatus according to claim 1, further comprising a first transfer unit arranged downstream relative to the defibrating unit and upstream relative to the deposition unit in a transfer direction in which the defibrated material is transferred, the first transfer unit being configured to transfer the defibrated material and the additive agents to the deposition unit, the supply unit further having a storage unit configured to store the additive agents to be supplied to the defibrated material, and a second transfer unit configured to transfer the additive agents stored in the storage unit to the first transfer unit, and the moisture adding unit being configured to add the moisture to the additive agents transferred in the second transfer unit.

3. The sheet manufacturing apparatus according to claim 2, wherein the moisture adding unit has a sprayer port configured to spray the moisture, and the sprayer port is arranged in the second transfer unit on a side closer to the storage unit than the first transfer unit.

4. The sheet manufacturing apparatus according to claim 2, further comprising a second moisture adding unit configured to add moisture to the first transfer unit and arranged further downstream in the transfer direction than a joint portion at which the second transfer unit is jointed to the first transfer unit and the first transfer unit and the second transfer unit communicate with each other.

5. The sheet manufacturing apparatus according to claim 1, wherein the supply unit is configured to select to supply or not supply the additive agents, and the moisture adding unit is configured to add the moisture when the additive agents are supplied.

6. The sheet manufacturing apparatus according to claim 1, wherein the supply unit is configured to control a supplied amount of the additive agents, the moisture adding unit is configured to control adding of the moisture, and the moisture adding unit is configured to control the adding of the moisture in response to the supplied amount of the additive agents.

* * * * *